US005280691A

United States Patent [19]

Rundmund

[11] Patent Number: 5,280,691

[45] Date of Patent: Jan. 25, 1994

[54] SLAB LINING

[76] Inventor: Theo Rundmund, Aastrasse 1, D-4422 Ahaus-Alstätte, Fed. Rep. of Germany

[21] Appl. No.: 634,151

[22] PCT Filed: Apr. 24, 1990

[86] PCT No.: PCT/EP90/00657

§ 371 Date: Feb. 20, 1991

§ 102(e) Date: Feb. 20, 1991

[87] PCT Pub. No.: WO90/12936

PCT Pub. Date: Nov. 1, 1990

[30] Foreign Application Priority Data

Apr. 25, 1989 [DE] Fed. Rep. of Germany ..... 89107410

[51] Int. Cl.[5] ..... E04C 2/38

[52] U.S. Cl. ..... 52/513; 52/384; 52/390; 52/604; 404/34

[58] Field of Search ..... 52/513 OR, 384, 386, 52/387, 389, 390, 391, 392, 604; 404/34, 39

[56] References Cited

U.S. PATENT DOCUMENTS

| | | | |
|---|---|---|---|
| 2,114,475 | 4/1938 | Labra | 52/390 |
| 4,912,902 | 4/1990 | Weaver | 52/384 |

FOREIGN PATENT DOCUMENTS

| | | | |
|---|---|---|---|
| 0253042 | 1/1988 | European Pat. Off. . | |
| 0263587 | 4/1988 | European Pat. Off. . | |
| 119766 | 4/1901 | Fed. Rep. of Germany . | |
| 2348301 | 4/1975 | Fed. Rep. of Germany . | |
| 2547637 | 4/1977 | Fed. Rep. of Germany | 52/390 |
| 8905179.3 | 9/1989 | Fed. Rep. of Germany . | |
| 2032485 | 5/1980 | United Kingdom . | |
| 2090307 | 7/1982 | United Kingdom . | |

OTHER PUBLICATIONS

J. R. Panek et al., "Construction sealants and adhesives", John Wiley & Sons, Inc., 2nd Ed. pp. 270–273.

*Primary Examiner*—Carl D. Friedman
*Assistant Examiner*—Wynn Wood
*Attorney, Agent, or Firm*—Felfe & Lynch

[57] ABSTRACT

Tiles, particularly for a liquid-tight and or acid- and alkali-resistant floor and wall covering. The covering has improved setting and service properties so that they are easy to set while voids are avoided, their leak-proof nature being of a high and long-lasting quality, and the tiles exhibit a high stress resistance. The tiles utilize alternating projections and indentations insuring that the adhesive material completely penetrates even narrow joints since the material enters those areas not only from the bottom but also from the sides and thus flows into narrow joint areas where the distances to be covered are very short.

13 Claims, 5 Drawing Sheets

Figure 1:
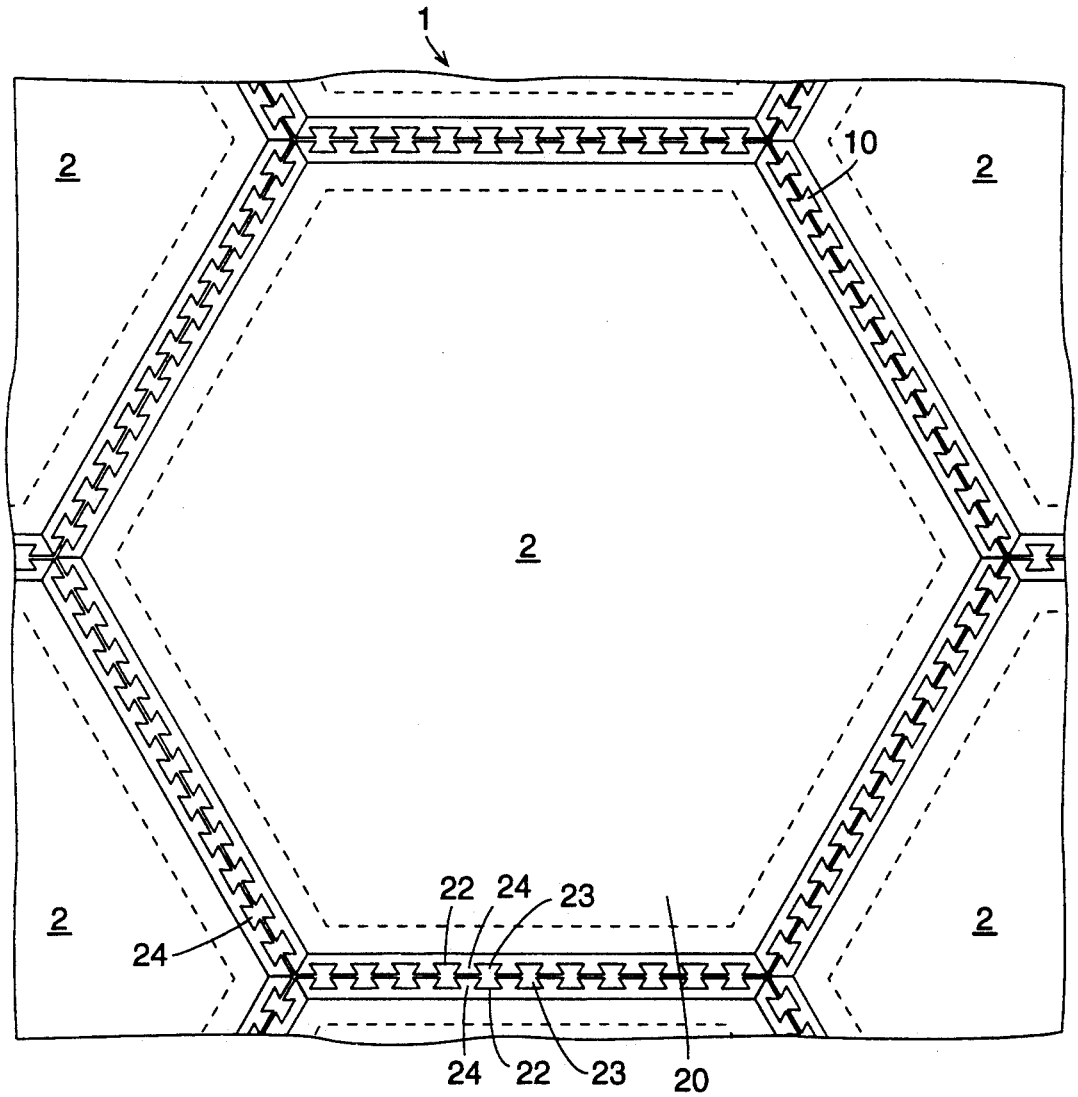

FIG. 4
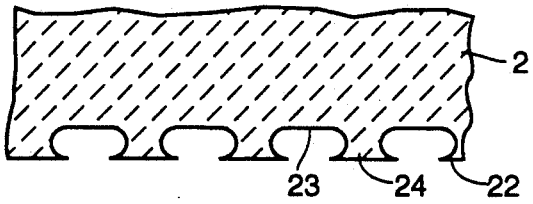
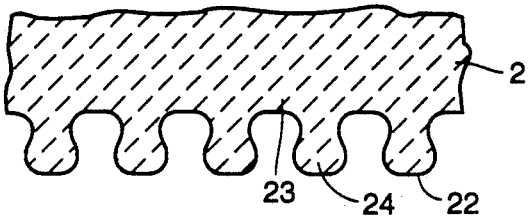
FIG. 5
FIG. 6
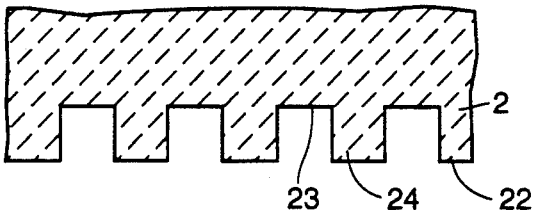
FIG. 7
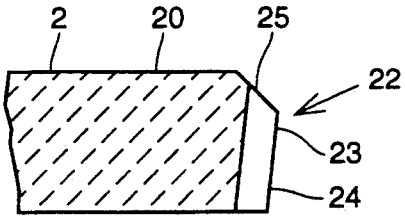
FIG. 8
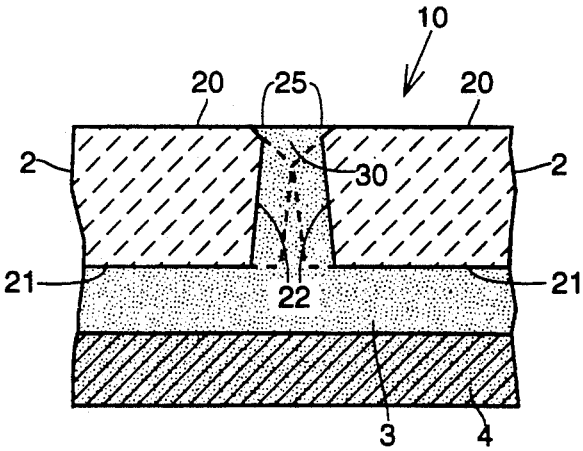

FIG. 12
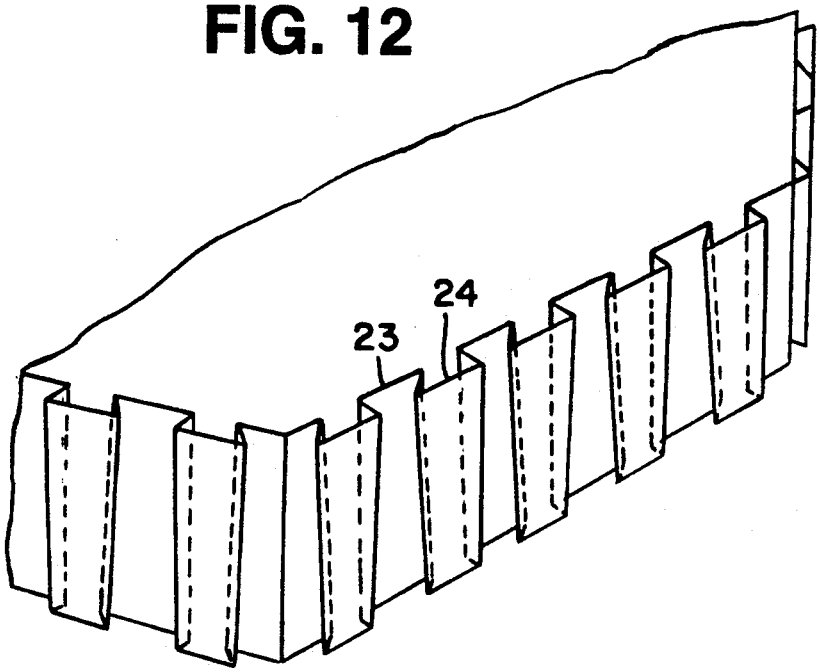
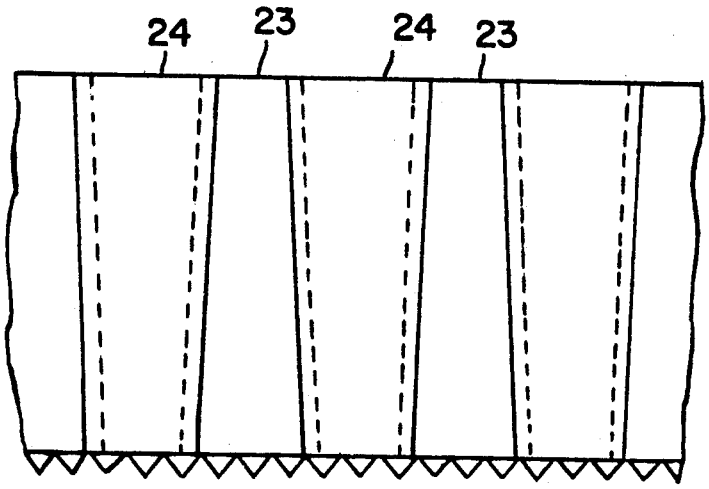
FIG. 13

SLAB LINING

The invention relates to tiles, particularly for a liquid-tight and/or acid- and alkali-resistant floor and wall covering.

A covering for such a use consisting of tiles is known from DE 23 48 301, for example. In this covering, the tiles are also in a bed of adhesive material where during the manufacture of the covering, the full contact between the adhesive material, on the one side, and the bottom of the tile and the sides thereof, on the other side, is established by mechanically shaking the tiles. In order to ensure a high load capacity and a good plane surface of the finished covering, and allow for this mechanical shaking without a displacement of the tiles, the latter are set in close contact which results in very narrow joints. On the one hand, this is desired, on the other hand, however, this causes a part of the joints to be not or only incompletely filled with adhesive material since the material cannot rise from the bottom up into the joints. This in turn requires subsequent works which, in most case, however, do not reach the necessary standard of quality since it is difficult to fill narrows joints to completion from the top. The problem is made more difficult in that it is hard to detect faulty or defect spots in the joint filling. It is thus possible that the covering can be leaking from the beginning or will leak prematurely. Further, the mechanical strength will be decreased, in particular during varying thermal stress and under the action of tangential forces.

An artificial stone or an artificial tile for manufacturing wall or ceiling coverings, pavements or the like is known from DE 119 766. At its sides, this tile has cavities which expand toward the interior and do not completely traverse the thickness of the tile, or it has protruding tabs which the basic material enters when the tile is pressed in the support piece made of a hardening material. This hardening of the basic material does not only join the tiles to their support but also joins them among each other. The cavities are either continuous, elongated indentations or a successive arrangement of a few longitudinal indentations aligned with one another where the longitudinal axes run parallel to the side sides of the tile. In a sectional view perpendicular to the top of the tile, the cavities can have dovetail configurations. The alternatively possible tabs, in a top view of the tiles, have a trapezoidal contour. The base, i.e. their broader side, always faces the corresponding tile. With these measures, it is possible to enlarge the surface of the tile sides in the area of the joints. However, interruptions in the joint filling still may easily occur and, hence, cause leaks. This can occur in particular when these tiles are subject to high alternating mechanical and/or thermal stress. Moreover, it is hardly possible to fill the cavities of such tiles to completion with basic material and/or the material used for the bed of adhesive agent since there is no complete displacement of air out of the cavities during the setting of tiles or the filling of the joints. What remains are hollow spots, so called voids, in the adhesive material if the bed or the joint filling.

It is hence an object to provide a covering of the aforesaid kind where the setting and the service properties are improved. This means, they should be easy to set while voids are avoided, their leak-proof nature should be of a high and long-lasting quality, and they should exhibit a high stress resistance.

This object is accomplished by a covering of the aforesaid kind in accordance with the invention which has the features of claim 1.

The invention allows maintaining a defined joint space even when employing the close contact setting which greatly facilitates and accelerates the setting procedure of the tiles. While the covering is produced, this space fills or can be filled with adhesive agent. The alternating projections and indentations ensure that the adhesive material completely penetrates even narrow areas of the joints since the material enters those areas not only from the bottom but also from the sides and thus flows into narrow joint areas where the distances to be covered are very short. The capillary forces which are generated during a preceding moistening enhance this flow. The air displaced from the bottom of the tiles and from the joints escapes readily and freely toward the top of the covering without requiring additional measures. Voids underneath the tiles in the bed of adhesive material and in the joints in the filling material for the joints are thus avoided. While the setting is quick and easy, the covering is of a high quality and leak-proof and no new operational steps are required for this purpose during manufacture. In case there is a suitable, rigid base, the new covering even allows omitting leakage or drainage layers that are provided underneath the tiles for safety purposes. The configuration of the tiles keeps manufacture relatively simple. It is possible, for example, to produce the structuring of the sides of ceramic tiles already during their forming, hence, prior to the baking of the tiles. Aside from ceramic, the materials for the tiles may also include metal, carbonaceous materials, plastic with and without fillers, or even natural minerals like natural stone and wood.

The invention further substantially improves the adhesion between the adhesive mass and the tiles in the area of the tile sides and, hence, the connection between adjacent tiles. The covering can thus withstand mechanical, thermal and chemical stress much better and over a longer period of time. Leakages due to interruptions in the adhesive mass of the tile sides are avoided to a large extent with the new covering. The covering hence offers improved safety against leakages and a prolonged service life without repair and replacement of parts.

In a preferred embodiment provision is made that the indentations, in a sectional view parallel to the plane of the tiles, have undercuts. In this undercut embodiment, the mutual clamping and joggling provides a particularly strong connection between tile sides and joint filling and hence between adjacent tiles. The entire covering is then very stable, extremely well leak-proof and durable.

For the setting of the tiles of the floor covering, an embodiment of the invention proposes that at their sides facing each other, one of two adjacent tiles has a projection engaging an indentation of the other and vice-versa. This allows a particular close setting of the tiles with a small percentage of joint space which in turn results in an especially smooth surface of the covering. Further, the particularly strong mechanical connection of the tiles among one another accounts for a high load-carrying capacity of the covering. An alternative setting form of the tiles proposes that of the two opposing sides of adjacent tiles an indentation in the one side faces an indentation in the other side, and a projection of the one side faces a projection of the other side. The setting form has the particular advantage that the tiles can be set quickly and easily, and the particular strong adherence between sides and joint filling and, hence, among the tiles themselves is ensured.

Preferred contour forms of the indentations and projections can be understood from claims 5, 6 and 7.

With respect to the dimensional arrangement of the projections and indentations, provision is made in the new covering such that the ratio between length of the main axis of the tile running in the plane of the tile, on the one hand, and the depth and width of an indentation and/or the horizontal length and width of a projection in the plane of the tile, on the other hand, range between 10:1 and 200:1. The projections and indentations are hence small relative to the dimension of the tiles so that they do not require more space than the joint space usually provided for conventional tiles. Moreover, it is thus possible to arrange a comparatively large number of projections and indentations at each tile side. Further, each tile retains its regular characteristic appearance which, in a top view, is the formation of a geometric surface limited by clear contours, for example, a square, a rectangle, a hexagon etc.

In order to further adjust the appearance of the finished covering to the one of conventional tiles, and in order to obtain a best possible smooth and straight surface of the joint filling in the area of the upper joint end, the edges of the tiles formed by the sides and the top are chamfered. The extension of the chamfering in the plane of the tile is equal to or greater than the depth of the indentations in the plane of the tile and/or the length of the projections in the plane of the tile in the sides.

In order to manufacture the tiles for the new tile lines in casting or pressing molds, the invention proposes that the tiles have a conical configuration with the sides slanting toward the inside or the outside if looked at from the bottom to the top. This allows an easy withdrawal of the tiles from the molds. Moreover, the resulting wedged form of the joints, open toward top or bottom, allows an improved, reliable filling of the joints with filling material between adjacent tiles. The conicity of the tiles preferably ranges between 1 and 5% of the tile thickness. At a tile thickness of 10 mm, for example, this means that in the plane of the top, the tiles are 0.1–0.5 mm smaller or larger than in the plane of the bottom side. The joint between two adjacent tiles of this kind would then be 0.2–1.0 mm larger at the top than at the bottom and vice-versa.

Further provision is made for the indentations to extend conically in one direction, if looked at in direction of their longitudinal axis, and for the projections, in the same direction, to be conically reduced. This also accounts for the advantages explained in the previous paragraph.

In order to simplify the setting of the tiles to form a covering, which is still done by hand, the invention proposes that in their longitudinal extension, the sides of the tiles have a concave configuration. The individual tiles thus contact one another only in the area of their corners whereas over a substantial part of their length of their sides they maintain a distance thus forming a defined joint space. In the practice, a relatively small curving is sufficient, e.g. ranging between 1 to 5 mm, measured in the longitudinal center of the side.

Another embodiment of the invention which also serves the purpose of simplifying the setting of the tiles proposes that spacers in the form of projections are disposed on the sides at or next to the corners. In this embodiment, the tiles border one another only in the area of the spacers whereas the sides of the tiles remain spaced apart thus forming again a defined joint space. The projections are preferably configured as one piece with the corresponding tile. Their height can also be defined such that they are no longer visible once the joints of the covering are filled.

Further, the invention also determines that the adhesive material and/or the joint filling material for the aforedescribed new covering is a known low-viscous acid-resistant cement on the basis of epoxide resin, polyester resin, phenol resin or furane resin.

Due to their advantageous properties, in particular with respect to their leak-proof quality and their service life, the coverings of the present invention can be used in manifold ways. Fields of application include, for example, acid-resistant constructions, acid protection technology and surface protection technology.

Particular importance is attached to food and beverage industry as well as to chemical industry. As far as the latter is concerned, the coverings are suitable for collecting chambers of tanks and, generally, for any place requiring chemically resistant and/or leak-proof floor or wall coverings. This includes the entire field of industrial construction, kitchens and slaughterhouses as well as private areas of application such as porches, terraces, bathrooms and swimming pools where these covering come in contact with moisture and/or liquids.

Figure 2:
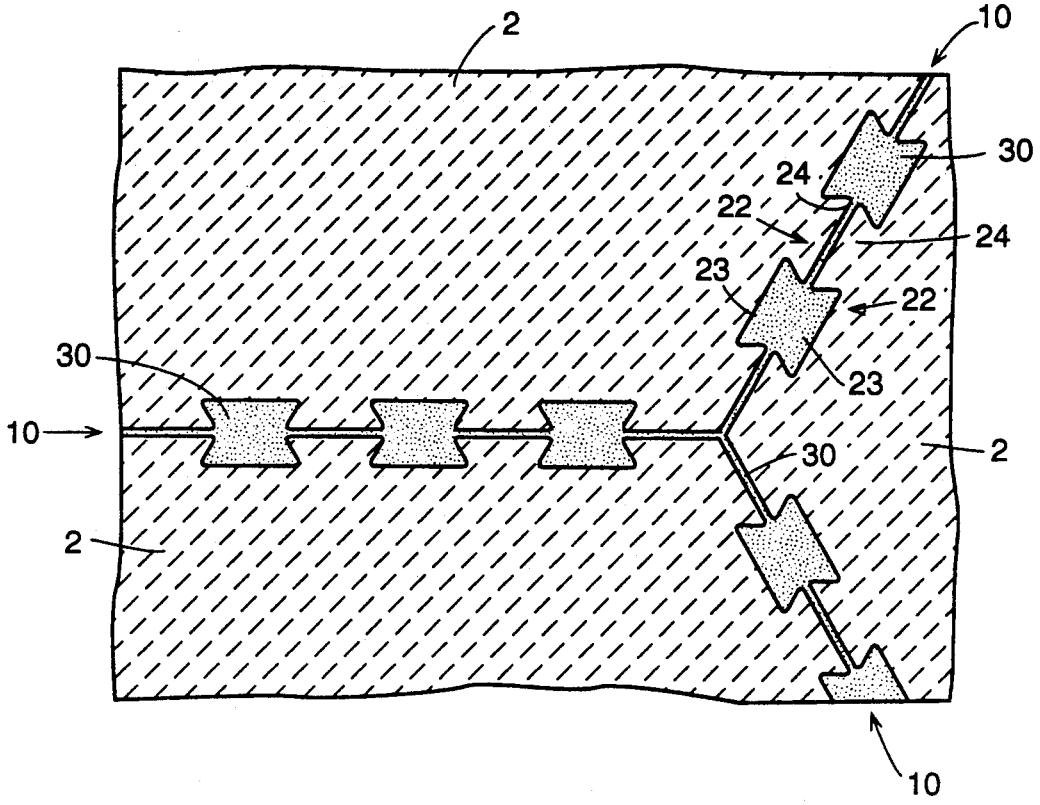
Figure 3:
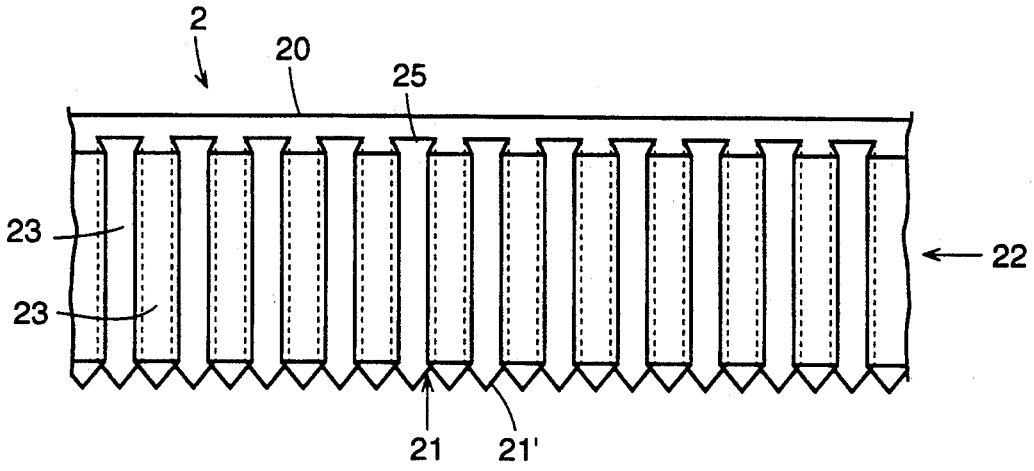

Embodiments of the drawing are subsequently explained with reference to a drawing wherein FIG. 1 is a partial top view of the upper side of a floor or wall covering, FIG. 2 is a partial section of this covering parallel to its upper side, FIG. 3 is a partial view of a side of a tile for a floor or wall covering, FIGS. 4, 5 and 6 show the side of a tile, each in another configuration, and represented corresponding to FIG. 2

Figure 9:
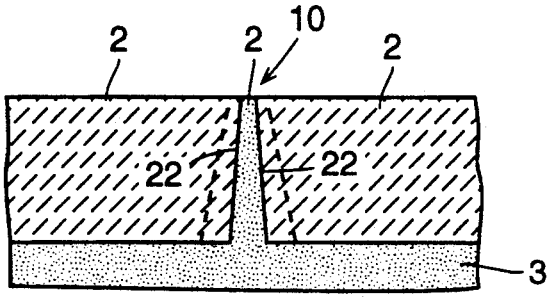
Figure 10:
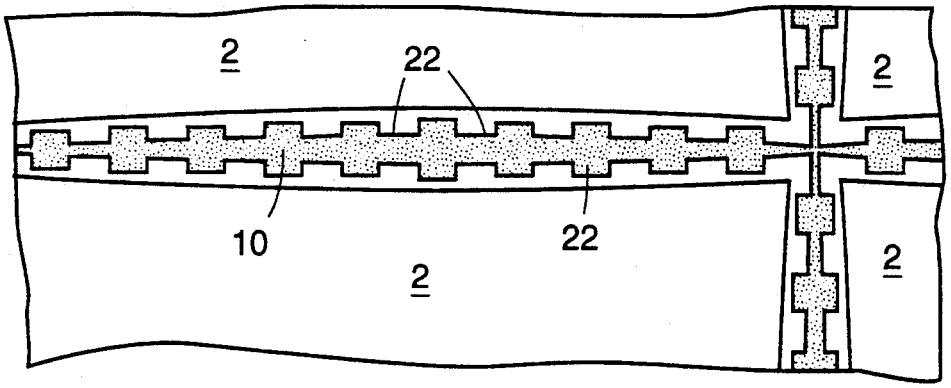
Figure 11:
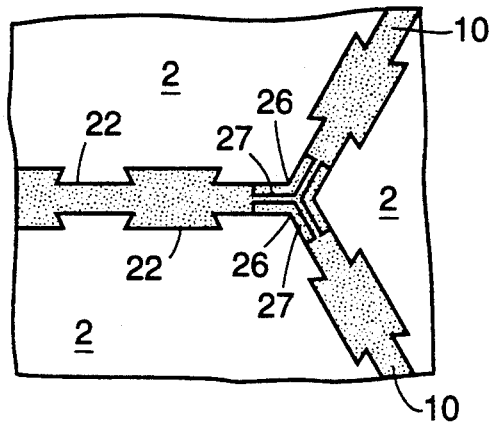

FIG. 7 is a partial cross section of a tile across the side area,

FIG. 8 shows the covering consisting of tiles according to FIG. 7 in a partial cross section of the joint area, FIG. 9 shows the covering in yet another embodiment, again in a partial cross section of the joint area, FIG. 10 is a top view of the floor covering in an embodiment with concave tile sides, FIG. 11 is also a top view of the covering in an embodiment with spacers at the corners of the tiles, FIG. 12 is a fragmentary perspective view of a tile, and FIG. 13 is a side vies of the FIG. 12 tile.

As seen in FIG. 1 of the drawing, this first embodiment of tiles for a floor or wall covering 1 includes hexagonal tiles 2. With their non-visible bottom side, these tiles are inserted in a bed of adhesive material and border an adjacent tile 2 along their circumference. At their two opposing sides 22, the tiles are structured. This structure is formed by dovetail-like indentations 23 and projections 24 running perpendicular to the longitudinal side axis. Joints 10 are thus created between the tiles 2 which have the form of a chain of wing-like indentations which, in a cross section, run parallel to the plane of the tile. Between each wing-like joint area, there is another smaller joint area. When manufacturing the floor or wall covering 1, the joints, from the bottom up, fill with the adhesive material used for embedding the tiles 2. Since this material also expands toward the side, it reaches even the small joint areas. Alternatively or supplementary, it is also possible to apply additional joint filler from the top into the joints 10, e.g. by pouring, spreading or pressing.

FIG. 2 in particular shows the curve and the form of the joints 10 in the contacting area of three tiles 2. The shape of the sides 22 of the individual tiles 2 is such that one indentation 23 of the one tile 2 is located exactly opposite the indentation 23 of the adjacent tile 2. Analogously, the two projections 24 face one another in adjacent tiles 2. FIG. 2 also shows the filling of the joints with the adhesive material and/or filling material 30. After the solidification thereof, the tiles are firmly connected to one another due to undercuts in the indentations 23. As compared to the first embodiment of FIG. 1, the corners of the indentations 23 and projections 24 are slightly rounded. Depending on the material, this may simplify the manufacture of the tiles 2.

The partial side view of side 22 of tile 2 of FIG. 3 shows that the indentations 23 and projections 24 have parallel longitudinal axes which are oriented perpendicular to the longitudinal axis of the side 22. FIG. 3 also shows that the number of indentations 23 and projections 24 is relatively large as compared to the dimensions of the tile 2.

In the area of the edge of tile 2 formed between the top 20 and side 22, there is a chamfering 25. The extension thereof in direction parallel to the top 20 of tile 2 is only so large that the indentations 23 do not extend to this top 20 but end in front thereof.

At the bottom side 21 of the tile of FIG. 3, there is a structuring 21' which consists of number of grooves and/or protruding strips of a triangular cross section, this number corresponding to the one of indentations 23 plus projections 24.

The various embodiments of the sides 22 of the tiles 2 seen in FIGS. 4, 5 and 6 are alternatives to the aforedescribed dovetail cross section of the indentations 23 and projections 24. In FIG. 4, the indentations 23, in a section parallel to the non-visible top 20 of tile 2, are to ¾ oval-shaped or ellipsoid. Therefore, the projections 24, in a sectional view, have a flat base which faces the adjacent tile 2 and a constricted passage toward the interior of tile 2.

In FIG. 5, side 22 of tile 2 has a meandering configuration which, in a sectional view, produces mushroom-like or club-shaped indentations 23 and projections 24.

Tile 2 of FIG. 6 has a side 22 where a sectional view shows rectangular and/or square-like indentations 23 and projections 24.

FIG. 7 clearly shows the configuration of tile 2 of FIG. 3 in a cross section of the area of the slanting side 22 with the section running exactly across an indentation 23. In the background, projection 24 can therefore be seen in a side view. In its upper part, side 22 is provided with the chamfering 25 already mentioned in connection with FIG. 3. The chamfering runs from the top of tile 2 to side 22 thereof.

In a representation corresponding to FIG. 7, FIG. 8 shows a segment of the covering in a cross section of the area of the joint 10. The two adjacent, slightly conical tiles 2 point toward each other with their slanting sides 22 and enclose a wedge-like joint 10. With their bottom 21, the tiles 2 rest in a supporting construction, i.e. a concrete board 4.

In the upper part, each of the sides 22 has a chamfering 25 forming the passage from the sides 22 to the tops 20 of two tiles 2. As further seen in FIG. 9, the joint filling 30 and/or the adhesive material of bed 3 fill the joint 10 completely and even with the top 20 of the two adjacent tiles 2. Because of this interaction with the chamfering 25, the structuring of the sides 22 at the top 20 of the covering and/or the tiles 2 thereof are not visible.

FIG. 9 shows an embodiment of the plates 2 where the sides 22 are slanted. This results in a joint 10 which also has a wedge-like cross section, however, it is expands from top toward bottom. This configuration is particularly suitable when the adhesive material 3 underneath the tiles 2 also serves as the joint filling material 30, i.e. when the joints 10 are not to be filled from the top.

The segment of the covering seen in FIG. 10, which is a top view, shows a concave configuration of the sides 22 of the tiles. The aforesaid structuring, which has the form of rectangular indentations and projections, is superimposed on the concave structure of the sides 22. The individual tiles 2 border only in the area of their corners whereas in the remaining area of their sides, they are spaced-apart. This facilitates the almost exclusively manual setting of the individual tiles 2 into a covering, and the filling of the joints 10 between the individual tiles 2 is made easier too.

Finally, FIG. 11, also a top view of the top, shows an embodiment of the covering where the corners of the individual tiles 2 are provided with projections 27 which serve as spacers. The projections provide the same advantages as achieved with the concave form of the sides as described in FIG. 10. As also seen in FIG. 11, the projections 27 are not provided over the entire height of the sides 22 but are smaller such they can no longer be seen from top once the joints 10 are filled. At the same time, a tight sealing of the joints is also ensured in the area of the projections 27.

In FIGS. 12 and 13 the indentations 23, as viewed in cross section in a longitudinal direction between the top and the bottom are formed conically enlarging and the projections 24, as viewed in cross section in the same longitudinal direction between the top and bottom are formed conically narrowing.

What is claimed is:

1. Covering of tiles for a liquid-tight covering, comprising: a bed of adhesive material, tiles of a polygonal contour, each tile when considered as being horizontal having a flat top, a bottom inserted in the bed of adhesive material and having sides extending from the bottom to the top wherein the sides of adjacent tiles bound joints which are filled with the adhesive material from the bottom up, wherein the sides have a structuring which increases the surface and enables penetration of the adhesive material through joints, wherein each side comprises a plurality of directly adjacent indentations and projections which have longitudinal axes running parallel to one another and essentially perpendicular to the longitudinal direction of the sides and wherein the tiles, in a section perpendicular to the plane of the tiles, have a frusto-conical configuration with slanting sides, the tiles having sides inclined outwardly as viewed in cross section from the bottom to the top, and the indentations as viewed in cross section in a longitudinal direction between the top and the bottom being formed conically enlarging and the projections as viewed in cross section in the same longitudinal direction between the top and the bottom being formed conically narrowing.

2. Coverings of tiles in accordance with claim 1, in which the indentations, in a sectional view parallel to the plane of the tile, are undercut.

3. Covering of tiles in accordance with claim 1, in which at opposing sides of two adjacent tiles, a projection in one tile engages an indentation in another tile and vice-versa.

4. Covering of tiles in accordance with claim 1, in which at sides of two adjacent tiles, one indentation in one side is located opposite an indentation in another side and one projection at the one side is located opposite a projection at the other side.

5. Covering of tiles in accordance with claim 1, in which a sectional view parallel to the top of the tiles, at least one of the indentations and the projections at the sides are dovetail-like.

6. Covering of tiles in accordance with claim 1, in which in a sectional view parallel to the plane of the tiles, at least one of the indentations and projections at the sides are at least one of $\frac{1}{2}$ to 182 circular, $\frac{1}{2}$ to $\frac{3}{4}$ oval and $\frac{1}{2}$ to $\frac{3}{4}$ ellipsoid.

7. Covering of tiles in accordance with claim 1, in which in a sectional view parallel to the plane of the tiles, the indentations and projections at the sides are rectangular.

8. Covering of tiles, in accordance with claim 1, in which the ratio between the length of a main axis of the tile extending in the plane of the tile and at least one of the depth and the width of an indentation in the plane of the tile and the horizontal length and width of a projection in the plane of the tile ranges between 10:1 and 200:1.

9. Covering of tiles, in accordance with claim 1, in which the upper edges of the tiles formed by the sides and the top are configured as chamferings, with the extension of each chamfering in the plane of the tile being at least equal to at least one of the depth of the indentations and the length of the projections in the plane of tiles in the sides.

10. Covering of tiles in accordance with claim 1, in which the conicity of the tiles ranges between 1 and 5% of the thickness of the tiles.

11. Covering of tiles in accordance with claim 1, in which in their longitudinal direction, the sides have a concave configuration.

12. Covering of tiles in accordance with claim 1, in which the tiles have corners and which includes spacers in the form of projections disposed on the sides next to the corners of the tiles.

13. Covering of tiles in accordance with claim 1, in which the adhesive material is a low-viscous acid-resistant cement on the basis of epoxide resin, polyester resin, phenol resin or furane resin.

* * * * *